US006581317B1

(12) United States Patent
Slates

(10) Patent No.: US 6,581,317 B1
(45) Date of Patent: Jun. 24, 2003

(54) GASEOUS ILLUMINATED FIBER OPTIC SIGHT

(75) Inventor: Scott O. Slates, Wentzville, MO (US)

(73) Assignee: Toxonics Manufacturing, Inc., Wentzille, MO (US)

( * ) Notice: Subject to any disclaimer, the term of this patent is extended or adjusted under 35 U.S.C. 154(b) by 0 days.

(21) Appl. No.: 09/587,819

(22) Filed: Jun. 6, 2000

Related U.S. Application Data

(60) Provisional application No. 60/138,529, filed on Jun. 10, 1999.

(51) Int. Cl.[7] ..... F41G 1/00
(52) U.S. Cl. ..... 42/132
(58) Field of Search ..... 42/132

(56) References Cited

U.S. PATENT DOCUMENTS

| | | | | | |
|---|---|---|---|---|---|
| 2,195,526 | A | | 4/1940 | Traver | 240/2.18 |
| 3,578,973 | A | * | 5/1971 | Dooley | 250/71 |
| 3,582,638 | A | | 6/1971 | Peters | 240/6.46 |
| 3,678,590 | A | | 7/1972 | Hayward | 33/241 |
| 3,880,529 | A | * | 4/1975 | Althause et al. | 356/251 |
| 3,945,127 | A | | 3/1976 | Spencer | 33/265 |
| 4,030,203 | A | | 6/1977 | Ackerman, Jr. | 33/241 |
| 4,070,763 | A | | 1/1978 | Carts, Jr. | 33/241 |
| 4,166,324 | A | | 9/1979 | Carollo et al. | 33/241 |
| 4,170,071 | A | | 10/1979 | Mann et al. | 33/265 |
| 4,177,572 | A | | 12/1979 | Hindes | 33/265 |
| 4,220,983 | A | | 9/1980 | Schroeder | 362/114 |
| RE31,515 | E | | 2/1984 | Heldt | 350/96.21 |
| 4,764,011 | A | * | 8/1988 | Goldstein | 256/251 |
| 4,928,394 | A | | 5/1990 | Sherman | 33/265 |
| 5,094,002 | A | * | 3/1992 | Saunders | 33/265 |
| 5,148,603 | A | * | 9/1992 | Beutler | 33/265 |
| 5,201,124 | A | | 4/1993 | Sherman | 33/265 |
| 5,231,765 | A | | 8/1993 | Sherman | 33/241 |
| 5,434,068 | A | | 7/1995 | Brooks et al. | 435/194 |
| 5,442,861 | A | | 8/1995 | Lorocco | 33/241 |
| 5,560,113 | A | * | 10/1996 | Simo et al. | 33/265 |
| 5,619,801 | A | | 4/1997 | Slates | 33/241 |
| 5,638,604 | A | * | 6/1997 | Lorocco | 33/241 |
| 5,649,526 | A | | 7/1997 | Ellig | 124/87 |
| 5,685,081 | A | | 11/1997 | Winegar | 33/265 |
| 6,016,608 | A | * | 1/2000 | Lorocco | 33/265 |

* cited by examiner

*Primary Examiner*—Charles T. Jordan
*Assistant Examiner*—Kimberly S. Smith
(74) *Attorney, Agent, or Firm*—Paul M. Denk

(57) ABSTRACT

A fiber optic pin sight, for use predominantly with an archery bow, or even with other firearms, includes a holder, supporting one or more fiber optic pin sights, and an illumination source at the back of the fiber optic material for use for furnishing an illumination to the fiber optic for its transmission through and for lighting the pin sights to facilitate the targeting when either directing an archery bow or firearm towards a target sight or to a quarry.

5 Claims, 3 Drawing Sheets

GASEOUS ILLUMINATED FIBER OPTIC SIGHT

This application claims the benefit of U.S. Ser. No. 60/138,529, filed Jun. 10, 1999.

BACKGROUND OF INVENTION

This invention relates generally to an illuminated sight, for use with archery, or perhaps even with shot guns, rifles, or other armaments, and more specifically pertains to the use of a fiber optic sight which is illuminated from a light generating source, to provide illumination to the tip of the sight and to facilitate its usage even under darkened conditions.

Fiber optic pins, for use with the sight, have long been available in the art. Such type pins can be seen in the U.S. Pat. No. 5,442,861, entitled Sight Pin and Holder for Archery Bow.

In addition, a prior patent to the assignee of the invention disclosed herein, U.S. Pat. No. 5,619,801, discloses a fiber optic pin sight for a bow.

Related types of developments can be seen in U.S. Pat. No. 5,649,526, also upon a bow pin sight, that utilizes fiber material as the sighting medium. In addition, U.S. Pat. No. 5,685,081, discloses an aiming device for use on an archery bow, that also utilizes the fiber optic concept. There are a variety of other fiber optic types of means for use for sighting purposes, and which utilize various style of connectors for supporting the fiber optic in its application and usage, such as shown in the prior patent No. Re. 31,515. There are also many very early U.S. patents that disclose the use of fiber optics, even in conjunction with lights, or mirrors, and for use with the transmission of light. Such can be seen in the early patent U.S. Pat. No. 2,195,526, upon an Illuminated Mirror.

Other patents utilizing fiber optics, for use in combination with a light source, can be see in U.S. Pat. No. 3,582,638, upon a Spot Lighting Device. The use of fiber optics for a gun sight, can be seen in U.S. Pat. No. 3,678,590. The sighting apparatus of Spencer, U.S. Pat. No. 3,945,127, shows the use of fiber optics in a sighting device. And, the sighting device utilizes a light source for its illumination. A sight illuminator is shown in U.S. Pat. No. 4,030,203. Another sighting device, using fiber optic or day glow plastics, or phosphorescent paints, is shown in U.S. Pat. No. 4,070,763, entitled Aiming/Sighting Device. And, an illuminated sight is shown in the early U.S. Pat. No. 4,166,324, that also utilizes a light source, and fiber optics for transmission of the light. Sighting apparatus, with light emitting diodes at their tips, and illuminated from a battery source, can be seen in U.S. Pat. No. 4,170,071. Another fiber optic pin sight is shown in U.S. Pat. No. 4,177,572, entitled Lighted Sight Pin for Archery Bows. Another illuminated bow sight is shown in U.S. Pat. No. 4,220,983. Another fiber optic bow sight, entitled Sight for Archery Bow, is shown in U.S. Pat. No. 4,928,394. Pat. No. 5,201,124, shows another type of illuminated archery pin sight. In addition, U.S. Pat. No. 5,231,765, shows an illuminated sight having a light collector serving a fiber optic. Another archery bow sight utilizing fiber optics is shown in Pat. No. 5,434,068.

Another patent using fiber optics as a light generating source, and for use for archery bow sight purposes, can be seen in U.S. Pat. No. 5,442,861.

Of more recent origin, at least with respect to sights employed with archery bows, whether it be for target practice, hunting, or even for use as a hunting sight with the firearms, is an illuminated pin produced by a company entitled Hesco, Inc., of LaGrange, Geo., and identified as the Meprolight. This particular sight utilizes at the tip of the sight a very small quantity of tritium in gaseous form, usually 20 millicuries or less, and which are encapsulated within a supporting tiny vessel, and then further encapsulated within a metal casing, that only provides a small aperture there through for the generation and display of a light source. This particular sight, produced by this company, uses the bead of encapsulated gas as the tip and sighting portion of the sight as employed in combination with an archery bow.

The current invention contemplates the combination of a small bead of tritium gas, that may be exposed to the back end of a fiber optic wire or strand, and which transmits its generated light to the opposite tip of the fiber optic which becomes the focal point for sighting when used in combination with a bow, or other firearm.

SUMMARY OF THE INVENTION

This invention principally relates to the use of fiber optics in the fabrication of preferably a bow sight, or perhaps any sight used in combination with a hunting or target practice instrument, wherein the back end of the fiber optic sight, which may include one or more strands of the fiber optic material forming a multiple sight, incorporates one or more of a small vessel of radioactive gas which provides a source of illumination for the fiber optic sight to furnish a glow at the sight tip upon which sighting is made on a target or quarry during usage and application of this embodiment.

This invention contemplates formation of a sight, which may be used individually, or in combination with a series of such sights, and which may be adjustable in their mounting, as known in the art. But each sight incorporates a strand of fiber optics, at their tip of which is provided with a surface from which light transmitted through the fiber optics, whether it be regular fiber optics or scintillating fiber optics, will provide for a glow to facilitate the sighting of the instrument, particularly when being used and employed in low light conditions. Thus, the invention contemplates a holder for the fiber optic sight, to provide for the emplacement of its various components at those locations required to facilitate sightings. In addition, the invention further includes means for mounting to the back end of each fiber optic sight, a supply of radioactive means, such as tritium, in gaseous form, which may be contained within a vessel, and which has a small area that can be exposed to the back end of the fiber optic forming the sight. Thus, such radioactive gas is known to provide illumination, and this generation of light, when exposed to the back end of the fiber optic sight, transmits such light through the fiber optics to its tip, to facilitate its use for sighting purposes, particularly when employed and used upon an archery bow. It is just as likely, though, that the concept of this invention could be used in combination with other forms of sights, that may be employed upon firearms, rifles, shot guns, or other means for sighting. Hence, the principal object of this invention is to provide the use of a radioactive gas in combination with the source end of the fiber optics to furnish light for illuminating the tip of the fiber optic when employed within a sight to allow its usage for aiming purposes, even when used in low light or night time conditions.

Another object of this invention is to provide a holder for supporting a length of fiber optic in a sight, and which further mounts at the back end of the fiber optic a radioactive gas, that generates its own illumination for transmission through the fiber optics into its tip for sighting purposes.

Still another object of this invention is to provide a mount for use in combination with a fiber optic holder, and which may be integrally formed therein, and to which a capsule of radioactive gas, such as tritium, may be located for a provision of a rumination source for lighting of the fiber optics and allowing for its usage within a bow or other instrument sight.

These and other objects may become more apparent to those skilled in the art upon reviewing the summary of this invention, and upon undertaking a study of the description of its preferred embodiment, in view of the drawings.

BRIEF DESCRIPTION OF THE DRAWINGS

In referring to the drawings, FIG. 1 provides a top view of a holder for a fiber optic pin sight, and the means for supporting the radioactive gaseous capsule for illuminating such fiber optic.

DESCRIPTION OF THE PREFERRED EMBODIMENT

Figure 1:
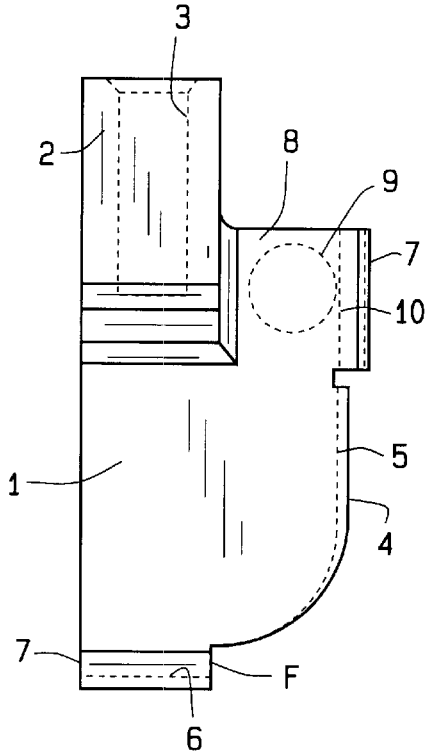
Figure 2:
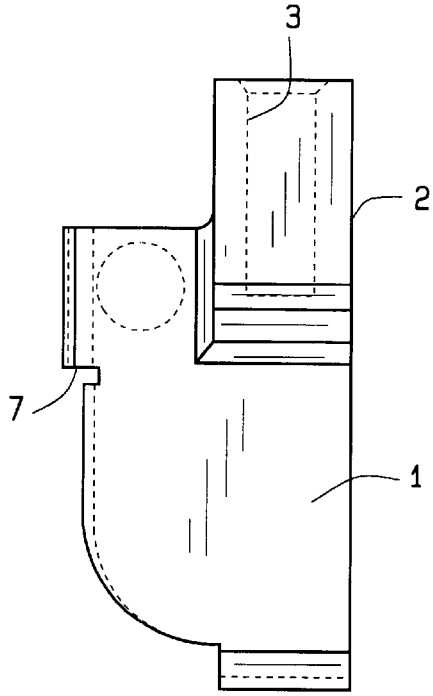
FIG. 2 is an bottom view thereof.
Figure 3:
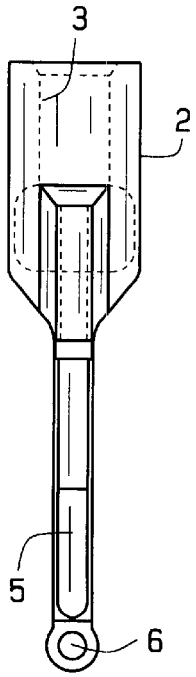
FIG. 3 is a front view thereof.
Figure 4:
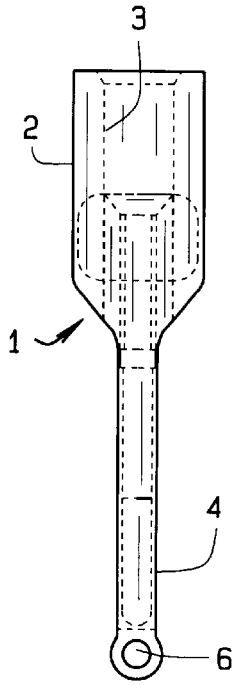
FIG. 4 is a rear view thereof.
Figure 5:
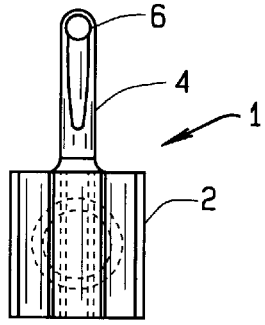
FIG. 5 is an end view thereof.

In referring to the drawings, and in particular FIGS. 1 through 5, a holder 1 for use in an archery bow sight, is fabricated with a back base portion 2, integrally formed therewith, and which includes a cavity 3 into which means for mounting of said holder to a sight, can be achieved. The front of the holder, as at 4, includes an arcuate cavity, as at 5, and into which a strand of fiber optic F may locate, with the front tip of the fiber optic being rearwardly disposed, and passes through a cavity 6 to locate the front or sighting tip of the fiber optic towards the archer, employing the bow either during target practice or while hunting. It is this tip of the fiber optic that becomes illuminated, that facilitates a sighting of the bow, during its usage. The back end of the fiber optic F extends through a further cavity 7 and into which the back end of the fiber optic locates, to be exposed to the illumination means. At the side of the holder is also provided a further cavity, as at 8, and it is within this cavity that a capsule 9 of radioactive gas, such as the type as previously explained, namely, a capsule of a small quantity of tritium, or other radioactive gas, in gaseous form, locates. These particular capsules of tritium or other radioactive gas, as previously explained, are furnished encapsulated within a metal casing, or sphere, and which have a pin hole in them for allowing the illumination from this source to generate, and in this particular instance, the capsule 9 locates within said cavity 8, and its pin hole emission point is directed towards the small passage 10 located between the cavity 8, and the cavity 7, so that the light emitted from the capsule will be reflected onto the adjacent back end of the fiber optic pin sight. Since this type of fiber optic is of the scintillating type, it may absorb light, even along the length of its surface, and direct such light internally of the fiber optic to its tip T, normally located at the back end of the bore 6, and into which the fiber optic was previously emplaced.

Figure 6:
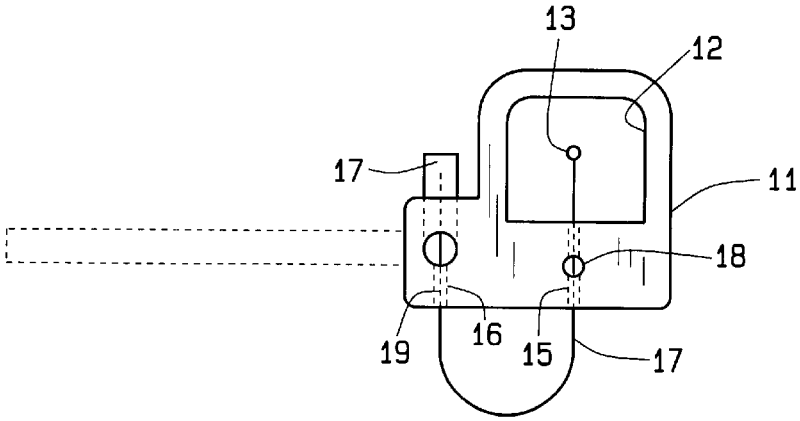
FIG. 6 is a top view of a modified type of holder for supporting the fiber optic pin sight, and the radioactive gaseous capsule.
Figure 7:
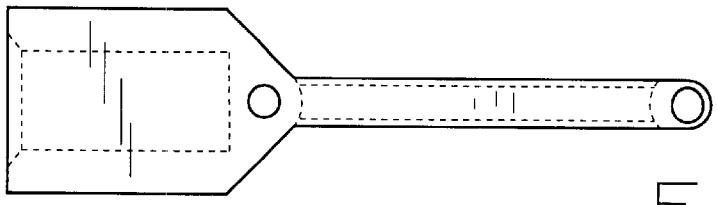
FIG. 7 is a back view of a holder for a fiber optic and incorporating a cavity for supporting a radioactive gaseous capsule.
Figure 8:
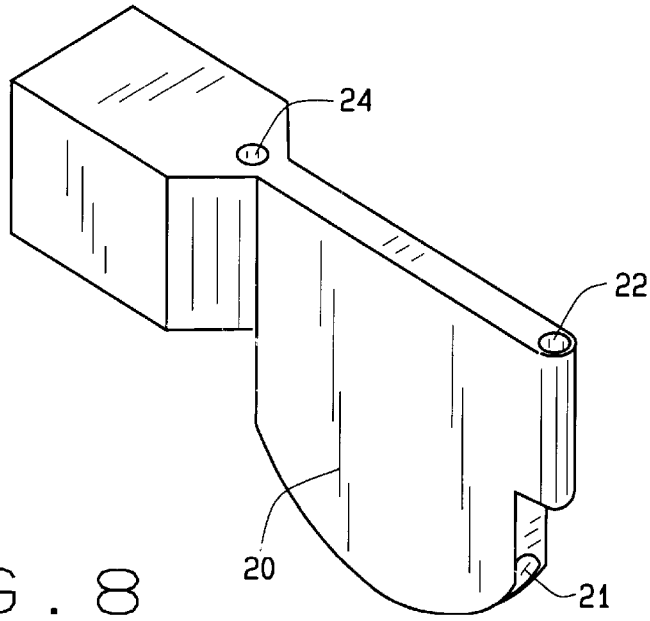
FIG. 8 is a perspective view thereof.
Figure 9:
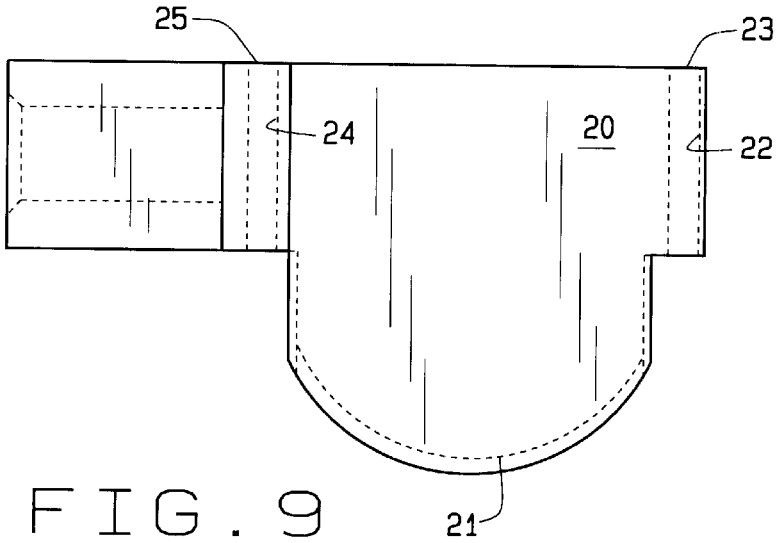
FIG. 9 is a top view thereof.
Figure 10:
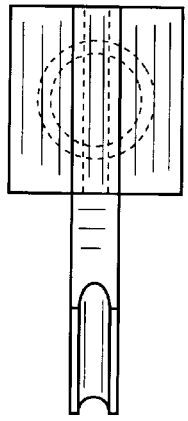
FIG. 10 is an end view thereof.
Figure 11:
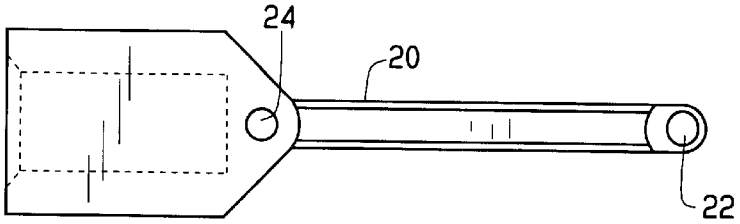
FIG. 11 is a back view thereof.
Figure 12:
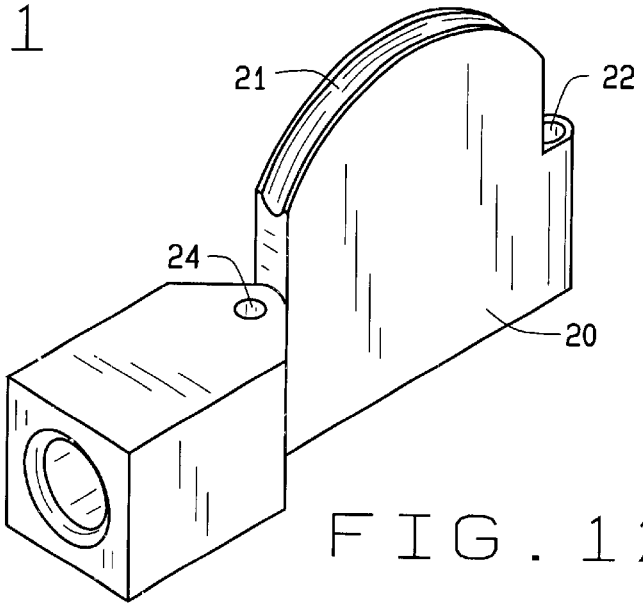
FIG. 12 is an perspective view of the holder from the opposite angle as shown in FIG. 8.

A further embodiment for the pin sight of this invention is shown in FIG. 6. This particular holder includes a fiber housing 11, having an opening 12 provided there through, and the upper tip 13 of the strand of fiber optic 14 is located approximately centrally of the opening 12, to facilitate sighting by the archer. The fiber optic, after passing through the cavity 15 is bent around for locating within a second cavity 16, to expose its back end to the tritium lamp 17 that also locates within said cavity 16, of the housing 11. A set screw 18 may be employed for holding the strand of fiber optic 14 in place, within the holder. Likewise, a similar type of fastener, or set screw may be used in conjunction with the cavity 16, to hold the back end 19 of the fiber optic in place.

Another holder for supporting both the fiber optic, of the pin sight, and the tritium lamp can be seen in FIG. 7 through 12. This holder 20 includes, along its front edge, a grooved or troughed edge 21, and into which a length of fiber optic may locate. The front edge of the fiber optic passes through a cavity 22 so as to expose the tip of the fiber optic, at the location of the region 23, to facilitate sighting by the archer located there behind. The opposite end of the fiber optic extends into the cavity 24, and which cavity may also hold, at its opposite opening 25, one of the tritium gas lamps as previously described. Thus, the light generated from the tritium lamp illuminates the back end of the fiber optic strand, which transmits said light through the fiber optic into its tip 13 to provide for illumination thereat, and to facilitate sighting, in a manner as previously described.

Obviously, a plurality of these holders 20 may be incorporated into an archery sight, and may be adjusted vertically, to facilitate the sighting, and the adjustment of the sight, by the archer.

These are examples of the essence of this invention which is to combine a fiber optic sight, to furnish a glow at its tip, or at that sight point focused upon by the archer, or hunter, when employing their bow or firearm, and further providing a light source, in this case, generated from a radioactive gas, at the back end of the fiber optic, to transmit light through the fiber optic for sighting purposes.

Variations or modifications to the subject matter of this invention may occur to those skilled in the art upon reviewing the disclosure provided herein. The disclosure as set forth herein, and as shown in the drawings, and any variations thereon, are intended to be encompassed within the scope of this invention. The description of the preferred embodiment provided herein, in view of the drawings, is set forth for illustrative purposes only.

What is claimed is:

1. A fiber optic pin sight for use with an archery bow, the A pin sight including a mounting body; a holder extending from the mounting body, said holder having a grooved curve along at least one edge; an optic fiber mounted to the holder, and locating within the grooved edge of the holder, and having a first end and a second end; the optic fiber first end being proximate the mounting body and the fiber optic second end being adjacent a forward edge of the holder, and a self-illuminating light source adjacent the fiber optic first end; the pin sight including a path of communication between the light source and the fiber optic first end to allow light from the light source to enter the fiber optic; the light source being a gas, the gas being encapsulated in a capsule, the capsule including an opening through which the light generated by the gas can escape; the capsule being adjacent of the optic fiber; the optic fiber being a light absorbing optic fiber and the light from the capsule entering the optic fiber for traversing over its curved positioning to the second end to illuminate its pin to facilitate sighting.

2. The fiber optic pin sight of claim 1 wherein the light from the capsule entering the optic fiber from the side of the optic fiber.

3. The fiber optic pin sight of claim 1 wherein the light from the capsule entering the fiber optic from the first end of the optic fiber.

4. The fiber optic pin sight of claim 2 wherein tritium gas is encapsulated in the capsule.

5. The fiber optic pin sight of claim 3 wherein tritium gas is encapsulated in the capsule.

* * * * *